252-102 AU 166 EX
2/22/83 XR 4,374,639

United States Patent [19]

Claiborne

[11] 4,374,639

[45] Feb. 22, 1983

[54] SYSTEM FOR PREVENTING STATIC ELECTRICITY ON LAUNDERED TEXTILE MATERIALS

[75] Inventor: Barbara T. Claiborne, Hixson, Tenn.

[73] Assignee: Dixie Yarns, Inc., Chattanooga

[21] Appl. No.: 137,474

[22] Filed: Apr. 3, 1980

[51] Int. Cl.[3] ..... B08B 3/00

[52] U.S. Cl. ..... 8/137; 8/120; 252/8.9; 252/102; 427/242; 427/393.1; 428/279

[58] Field of Search ..... 252/8.9, 102; 427/242, 427/393.1, 11; 8/137, 120; 428/279

[56] References Cited

U.S. PATENT DOCUMENTS

| | | | |
|---|---|---|---|
| 2,131,120 | 9/1937 | Schlack | 525/504 |
| 3,442,692 | 5/1969 | Saiser | 8/120 |
| 3,510,246 | 5/1970 | Keen et al. | 8/116.2 |
| 3,632,396 | 1/1972 | Perez-Zamora | 428/291 |
| 3,686,025 | 8/1972 | Morton | 428/219 |
| 3,694,364 | 9/1972 | Edwards | 252/90 |
| 3,936,537 | 2/1976 | Baskerville et al. | 427/242 |
| 3,936,538 | 2/1976 | Marshall et al. | 427/242 |
| 4,065,257 | 12/1977 | Coe | 8/602 |
| 4,095,946 | 6/1978 | Jones et al. | 8/137 |
| 4,209,549 | 6/1980 | Murphy et al. | 427/242 |
| 4,246,670 | 1/1981 | Perrin et al. | 8/566 |

FOREIGN PATENT DOCUMENTS

| | | |
|---|---|---|
| 737759 | 2/1970 | Belgium . |
| 861515 | 6/1978 | Belgium . |
| 2608577 | 9/1976 | Fed. Rep. of Germany . |
| 39-5985 | 4/1964 | Japan . |

*Primary Examiner*—A. Lionel Clingman
*Attorney, Agent, or Firm*—Stevens, Davis, Miller & Mosher

[57] ABSTRACT

A system for preventing static cling among textile materials such as clothes in a washer by using in a liquid bath containing the textile materials a static preventing member having a textile substrate or the like reacted with a static preventing material such as N-trisubstituted ammonium 2 hydroxy 3 halopropryl compounds or salts of epoxy propyl ammonium compounds such as glycidyltrimethylammonium chloride. Such static preventing members, and the methods of making and using same are included.

7 Claims, No Drawings

SYSTEM FOR PREVENTING STATIC ELECTRICITY ON LAUNDERED TEXTILE MATERIALS

BACKGROUND

The present invention relates to a system for preventing undesirable static electricity which manifests itself as "static cling" among textile materials comingled in a liquid bath. The textile materials are typically clothes in a clothes washer. More particularly, this invention relates to a static preventing member for use in a conventional washing machine for laundering clothes to prevent accumulation of static electricity in the washed clothes both after washing and after drying, thus eliminating undesirable static cling among the washed clothes.

For as long as modern mechanical methods of washing and drying clothes have been used, and particularly in recent years when so many synthetic textile materials have been used in clothes, bedding and other washable household goods, undesirable "static cling" has been present in batches of laundered clothes, particularly after tumble drying those clothes. Typically, the attempted solutions to this longstanding problem have been attempts to deal with the problem in the dryer. There have been many attempts to decrease static cling by the insertion of some fabric softener or antistatic member into the dryer while textile materials are being tumble dried therein. See, for example Proctor and Gamble's BOUNCE made under U.S. Pat. Nos. 3,944,694 and 4,085,052; a corresponding product marketed by Giant Foods, Inc., Washington, D.C. under U.S. Pat. Nos. 3,442,692, 3,956,556, and 4,007,300; Economic Laboratories' FREE N' SOFT made under U.S. Pat. Nos. 3,967,008 and 4,004,685; Purex Corp.'s TOSS 'N SOFT; AND A. E. Staley's STA-PUF.

Another group of products are liquid fabric softeners which are also said to help eliminate static cling, which liquids are for use in washing machines. See, for example, Proctor and Gamble's DOWNY; A. G. Staley's STA-PUF; and S. C. Johnson & Sons; RAIN BARREL; and Giant Food's Fabric Softener. However, these types of products are known to have a tendency to make clothes somewhat yellow and to decrease the water absorbency of textiles. These are of course undesirable characteristics, particularly where absorbency is desired as in towels, diapers, etc. Additionally, Alberto Culver markets STATIC GUARD spray containing dimethyl ditallow ammonium chloride, but it is expressly not to be used in washers or dryers.

Quaternary ammonium compounds are disclosed as the active agents in some of the aforementioned patents, but compositions containing quaternary ammonium compounds are known to have other utilities in the textile industry. For example, Rupin, Michel, "Dyeing with Direct and Fiber Reactive Dyes," Textile Chemists and Colorist, Vol. 8, No. 9, September, 1976, pages 139/54–143/58, discloses the amination of cellulose as a method to facilitate dyeing of cellulose by direct and fiber reactive dyes. Rupin reports that quaternary ammonium compounds such as glycidyltrimethylammonium chloride (sold under the trademark Glytac by Societe Protex, Levellois, France) can be applied to fabric either prior to dyeing or simultaneously with reaction, for example by adding Glytac to the dye bath, resulting in improved dyeing efficiency and improved direct dye fastness for cellulose fabrics; similar applications to polyester/cotton blends are also suggested. The quaternary ammonium compounds, per se, are known as indicated in Rupin, supra, and the references cited therein, such as U.S. Pat. No. 2,131,120, British Pat. No. 971,358; French Pat. No. 1,4990,066; French Pat. No. 1,589,218; French Pat. No. 2,041,703; French Pat. No. 2,061,533; and French Pat. No. 2,096,702.

BRIEF SUMMARY OF THE INVENTION

It is, therefore, an object of this invention to provide a novel system for preventing accumulation of static electricity in laundered textile materials.

It is another object of this invention to provide a static preventing member.

It is another object of this invention to provide a simple and economical system for preventing static electricity in laundered tumble dried textiles while they are still in the laundry wash or rinse waters.

The foregoing objects and others are accomplished in accordance with the present invention wherein an static preventing member comprising a substrate, for example a textile substrate, reacted with a quaternary ammonium compound such as glycidyltrimethylammonium chloride is used in a liquid bath containing textile materials, wherein the static preventing member, while still in the liquid bath serves to decrease or prevent any later undesirable accumulation of static electricity among the textile materials thereby preventing undesirable static cling among those materials after they are tumble dried even without the static preventing member.

DETAILED DESCRIPTION

The problem commonly known as static cling in home and commercial laundries has long plagued housewives and businessmen. While most recent attempts to solve this problem have primarily been directed toward eliminating the undesirable static electricity at the time tumble drying is taking place, the present invention is a new approach attacking the problem while the textile materials are in a liquid bath, i.e., while clothes are in the washing machine undergoing at least the final rinsing cycle. More specifically, the present invention is directed to a static preventing member or cloth, and the method by which such a static preventing cloth is used.

The static preventing member or cloth of the present invention comprises two basic elements: first, a substrate, and second, a static prevention agent which is reacted with the substrate.

The substrate of the static preventing cloth of the present invention may take any desirable form, and may comprise any desirable material. However, that substrate will typically be a textile material, preferably cellulosic textile material. That textile material may take virtually any form, such as a woven, non-woven, or knitted fabric, a braided rope or ball, or any other desirable configuration. Even paper-like substrates may be used. The purpose of the substrate is to provide a carrier for reaction with a static preventing material, and to provide a sufficient area over which that material is accessible to the liquid in the bath, or wash or rinse water in which the static preventing member or cloth is to be used. One particularly suitable substrate is a towel-like piece of terrycloth cotton fabric. Another particularly preferred substrate is a non-woven fabric such as "Novonette" available from the Kendall Co., Walpole, Mass. It will be appreciated that any substrate which may be successfully reacted with the static preventing material and has sufficient wet strength and sufficient resistance to abrasion with other materials in a bath such as laundry wash or rinse waters, may be satisfactorily used as the substrate for the static preventing member of the present invention.

The static preventing material which is reacted with the substrate should be a material which, when present in the aforementioned substrate in a liquid bath, such as laundry wash or rinse waters, will effectively prevent later accumulation of static electricity in clothes or other textile materials when those textile materials are subsequently tumble dried, even without the static preventing member. The static preventing material may comprise a compound of the N-trisubstituted ammonium 2 hydroxy 3 halopropyl type of the general formula:

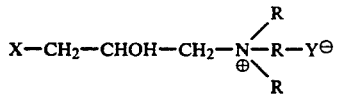

or salts of epoxy propyl ammonium (glycidyl ammonium) compounds having the general formula:

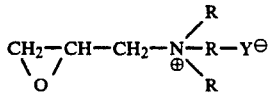

wherein X is a halogen radical, Y is chloride, bromide, sulfate or sulphonate, and the R's are methyl, ethyl, butyl or benzyl groups or alcohols thereof.

A particularly preferred static preventing material is glycidyltrimethylammonium chloride. A 40% aqueous solution of glycidyltrimethylammonium chloride is commercially available under the name Glytac from Societe Protex, Levellois, France.

The static preventing material may be applied to a desired substrate by any suitable means or method. Typically, a dilute aqueous solution containing about 10–200 grams per liter of the static preventing material will be prepared, and the desired substrate material passed through a bath thereof to impregnate fully the substrate material. The aqueous solution contains other ingredients such as a base, like sodium hydroxide or sodium carbonate, although any suitable base should work. The solution is made "slightly alkaline" which herein means having the alkalinity provided by sodium hydroxide present in a concentration of about 0.5–40 grams per liter, or the basic equivalent thereof. A preferred alkalinity is provided by using sodium hydroxide in a concentration of about 10 grams per liter. One or more surface active agents may be added to enhance wetting of the substrate material by the static preventing material solution. Impregnation of substrate materials in such aqueous solutions of static preventing material may be conducted at any suitable temperature, but lower temperatures are preferred and reaction is typically conducted at about room temperature. During reaction between the static preventing material and the preferred cullulosic substrate, the epoxide linkage is broken by the basicity and one of the resulting reactions is the formation of an ether linkage at one or more of the former hydroxy cites in the anhydroglucose unit of the cellulose.

The following examples further specifically illustrate the present invention wherein the novel static preventing members are made and used. The parts and percentages are by weight unless otherwise indicated. These examples are intended to illustrate various preferred embodiments of the novel static preventing system.

EXAMPLE I

A solution of static preventing material is prepared by mixing about 40 grams of Glytac (glycidyltrimethylammonium chloride commercially available from Societe Protex, Levellois, France) with about 10 grams of sodium hydroxide, about 10 milliliters of Tergitol TMN6 (a surface active agent available from Union Carbide), and about one liter of water. After thorough mixing of that solution, wash-cloth size pieces of white, terrycloth, cotton fabric are immersed in the solution, removed from the solution and excess solution extracted by passing the cloths through rubber wringer rolls. The cloths are then stored wet for about 12 hours. The cloths, with about 70–300% by weight of fabric of absorbed solution, are then washed by conventional means to remove any excess solution, and then dried.

EXAMPLE II

A solution of static preventing material is prepared as in Example I, and pieces of non-woven cellulosic fabric, available under the name "Novonette" from the Kendall Company, Walpole, Mass., are treated with the solution as described in Example I.

EXAMPLE III

A cloth made according to Example I was used by placing it in laundry in conventional equipment such as an automatic home laundry machine. In this test two garments, one pair of dark grey men's polyester trousers and one ladie's polyester knit, print blouse, were laundered using a gentle cycle, warm water and about 35 g of common laundry detergent. After washing, the garments were tumble dried, with heat, for about 40 minutes, without the static preventing cloth. Upon removal from the dryer, no static cling was observed in the garments.

EXAMPLE IV

The laundry and drying steps of Example III were conducted without the static preventing cloth made according to Example I. Upon removal from the dryer the garments exhibited severe static cling.

EXAMPLE V

A cloth made according to Example II is used by placing it in laundry in conventional laundry equipment such as an automatic home laundry machine. Common laundry detergents are used as usual. Bleaches and other laundry additives may also be used. Upon removal of the laundry after a normal machine cycle and then drying same in a tumble-dry dryer, without the static preventing cloth, no static cling is observed in the laundered fabrics.

EXAMPLE VI

The static preventing cloth used in Example I above is repeatedly reused as described in Example III. The inventive static preventing cloth may be reused in its wet condition.

EXAMPLE VII

The static preventing member-cloths made according to Example II are re-used in the same way described in Example V and VI above, with the same desirable results.

Although specific components and proportions have been stated in the above description of the preferred embodiments of the novel static preventing system wherein static preventing members are used, other suitable materials and minor variations in the various steps in the system as listed herein, may be used. In addition, other materials and steps may be added to those used herein, and variations may be made in the system to synergize, enhance or otherwise modify the properties of or increase the uses for the invention.

It will be understood that various other changes of the details, materials, steps, arrangements of parts and uses which have been herein described and illustrated in order to explain the nature of the invention will occur to and may be made by those skilled in that art, upon a reading of this disclosure, and such changes are intended to be included within the principle and scope of this invention.

What is claimed is:

1. A method of preventing accumulation of static electricity on textile materials which have been wetted in a bath and then tumble dried, comprising: providing a laundry bath with a plurality of textile materials therein, placing in said bath a static electricity preventing member comprising a textile substrate material reacted with a static electricity preventing material, said material comprising a compound from the group consisting of:

a N-trisubstituted ammonium-2-hydroxy-3-halopropyl compound having the general formula

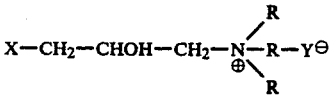

or a salt of epoxy propyl ammonium having the general formula

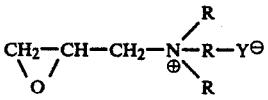

wherein X is a halogen radical, Y is chloride, bromide, sulfate or sulfonate, and the R's are methyl, ethyl, butyl or benzyl groups or an hydroxyl substituted derivative thereof, said static preventing member being in said bath during at least the final rinse stage of a laundering procedure, and then tumble drying said plurality of textile materials without the static preventing member, whereby said textile materials when thus dried do not exhibit static cling.

2. The method of claim 1, wherein the steps of claim 1 are repeated a plurality of times using the same static preventing member.

3. The method of claim 1 wherein said substrate is a cellulosic material.

4. The method of claim 1 wherein said substrate is a cotton fabric.

5. The method of claim 3 wherein said substrate is non-woven.

6. The method of claim 1 wherein said static electricity preventing material is glycidyltrimethylammonium chloride.

7. The method of claim 1 wherein said substrate is a non-woven cellulosic material and the static preventing material is glycidyltrimethylammonium chloride.

* * * * *